US006038801A

United States Patent [19]

Rutar

[11] Patent Number: 6,038,801

[45] Date of Patent: Mar. 21, 2000

[54] STICKER DISPLAY SYSTEM

[76] Inventor: Michael J Rutar, 726 N. Ridge Rd. E., Lorain, Ohio 44055

[21] Appl. No.: 08/833,904

[22] Filed: Apr. 10, 1997

[51] Int. Cl.[7] ..... G09F 21/04

[52] U.S. Cl. ..... 40/593; 40/643; 40/649

[58] Field of Search ..... 40/593, 611, 643, 40/649, 658, 661, 764, 765, 771, 774; 248/473, 466

[56] References Cited

U.S. PATENT DOCUMENTS

| | | | |
|---|---|---|---|
| 1,298,859 | 4/1919 | Anthony | 40/661 X |
| 2,153,149 | 4/1939 | MacHarg | 40/776 |
| 2,281,237 | 4/1942 | Eckman | 40/771 |
| 3,432,133 | 3/1969 | Schmid | 248/201 |
| 3,525,493 | 8/1970 | Chrietzberg | 40/658 X |
| 4,473,963 | 10/1984 | Hardy et al. | 248/473 X |
| 4,960,258 | 10/1990 | Stocker et al. | 248/473 |
| 5,441,224 | 8/1995 | Ludwig | 248/74.2 |
| 5,613,770 | 3/1997 | Chin, Jr. et al. | 248/220.1 |

FOREIGN PATENT DOCUMENTS

| | | | |
|---|---|---|---|
| 4113481 | 11/1991 | Germany | 40/593 |

*Primary Examiner*—Cassandra H. Davis

[57] ABSTRACT

A sticker display system for displaying a sticker in the rear window of a vehicle includes a display member and a pair of mounting brackets opposedly mounted in spaced relation adjacent the rear window of a vehicle. The display member is removably retained in the mounting brackets and a sticker is attached to the display member so as to be visible through the rear window of the vehicle.

8 Claims, 3 Drawing Sheets

FIG. 5
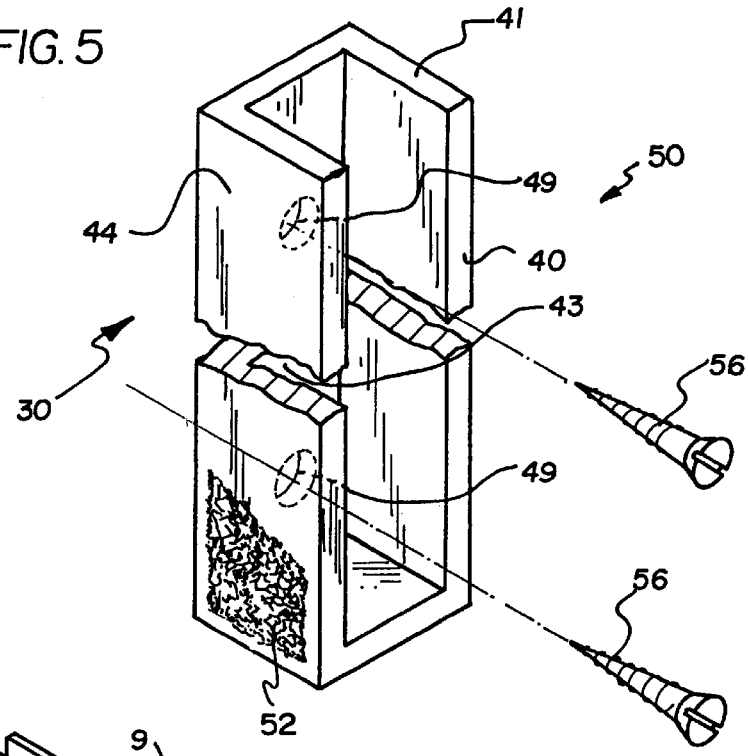
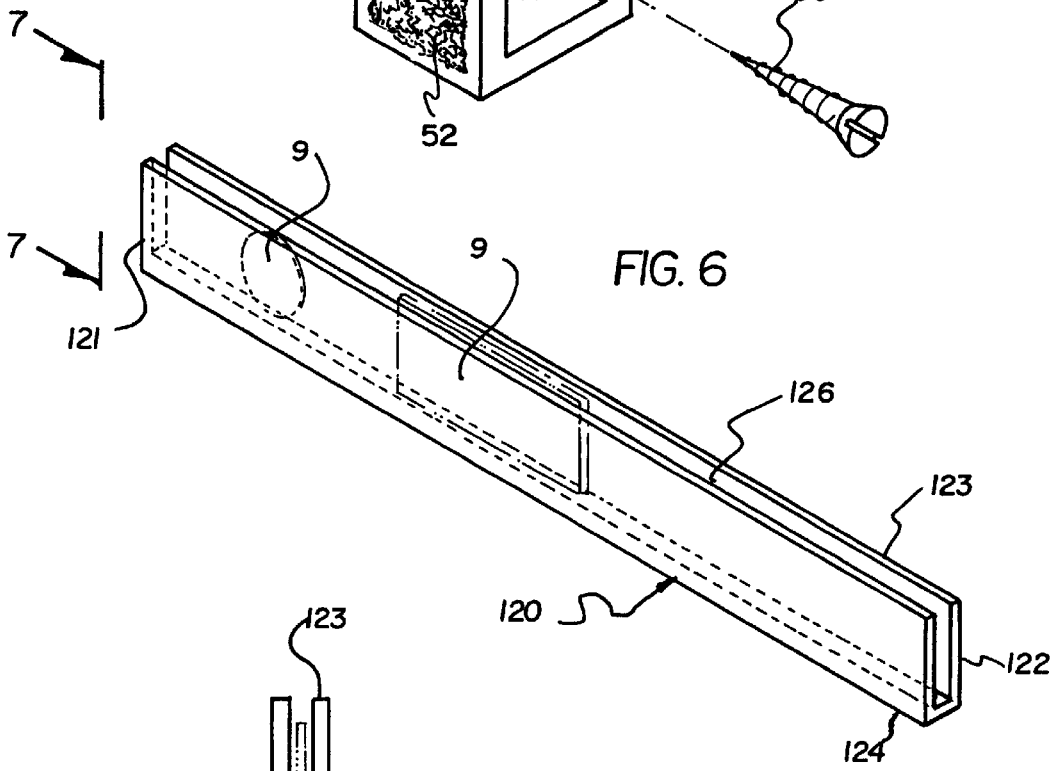
FIG. 6
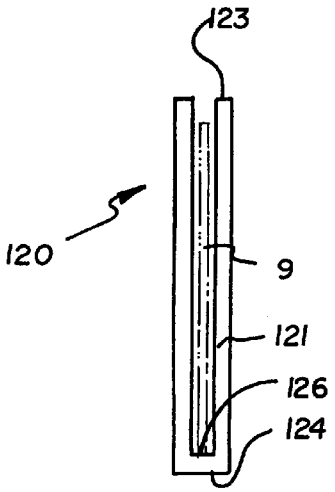
FIG. 7

STICKER DISPLAY SYSTEM

BACKGROUND OF THE INVENTION

1. Field of the Invention

The present invention relates to display systems and more particularly pertains to a new Sticker Display System for displaying a sticker in the rear window of a vehicle.

2. Description of the Prior Art

The use of display systems is known in the prior art. More specifically, display systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art display systems include U.S. Pat. No. 5,266,144; U.S. Pat. No. 4,756,106; U.S. Pat. No. D252,377; U.S. Pat. No. 5,386,960; U.S. Pat. No. 4,707,939; and U.S. Pat. No. 4,470,214.

While these devices fulfill their respective, particular objectives and requirements, the aforementioned patents do not disclose a new Sticker Display System. The inventive device includes a display member and a pair of mounting brackets opposedly mounted in spaced relation adjacent the rear window of a vehicle, wherein the display member is removably retained in the mounting brackets and a sticker is attached to the display member so as to be visible through the rear window of the vehicle.

In these respects, the Sticker Display System according to the present invention substantially departs from the conventional concepts and designs of the prior art, and in so doing provides an apparatus primarily developed for the purpose of displaying a sticker in the rear window of a vehicle.

SUMMARY OF THE INVENTION

In view of the foregoing disadvantages inherent in the known types of display systems now present in the prior art, the present invention provides a new Sticker Display System construction wherein the same can be utilized for displaying a sticker in the rear window of a vehicle.

The general purpose of the present invention, which will be described subsequently in greater detail, is to provide a new Sticker Display System apparatus and method which has many of the advantages of the display systems mentioned heretofore and many novel features that result in a new Sticker Display System which is not anticipated, rendered obvious, suggested, or even implied by any of the prior art display systems, either alone or in any combination thereof.

To attain this, the present invention generally comprises a display member and a pair of mounting brackets opposedly mounted in spaced relation adjacent the rear window of a vehicle, wherein the display member is removably retained in the mounting brackets and a sticker is attached to the display member so as to be visible through the rear window of the vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Sticker Display System apparatus and method which has many of the advantages of the display systems mentioned heretofore and many novel features that result in a new Sticker Display System which is not anticipated, rendered obvious, suggested, or even implied by any of the prior art display systems, either alone or in any combination thereof.

It is another object of the present invention to provide a new Sticker Display System which may be easily and efficiently manufactured and marketed.

It is a further object of the present invention to provide a new Sticker Display System which is of a durable and reliable construction.

An even further object of the present invention is to provide a new Sticker Display System which is susceptible of a low cost of manufacture with regard to both materials and labor, and which accordingly is then susceptible of low prices of sale to the consuming public, thereby making such Sticker Display System economically available to the buying public.

Still yet another object of the present invention is to provide a new Sticker Display System which provides in the apparatuses and methods of the prior art some of the advantages thereof, while simultaneously overcoming some of the disadvantages normally associated therewith.

Still another object of the present invention is to provide a new Sticker Display System for displaying a sticker in the rear window of a vehicle.

Yet another object of the present invention is to provide a new Sticker Display System which includes a display member and a pair of mounting brackets opposedly mounted in spaced relation adjacent the rear window of a vehicle, wherein the display member is removably retained in the mounting brackets and a sticker is attached to the display member so as to be visible through the rear window of the vehicle.

Still yet another object of the present invention is to provide a new Sticker Display System that provides an alternative to attaching a sticker directly to a vehicle since removal of a sticker attached directly to a vehicle can be very difficult.

Even still another object of the present invention is to provide a new Sticker Display System that allows for easy removal and replacement of a sticker without damaging the surface to which the sticker is attached.

Even still another object of the present invention is to provide a new Sticker Display System that allows for orderly display of a sticker in the rear window of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an illustration of a mounting bracket of the present invention.

FIG. 6 is an illustration of a second embodiment of the display member of the present invention.

FIG. 7 is an end view of the second embodiment of the display member of the present invention.

DESCRIPTION OF THE PREFERRED EMBODIMENT

Figure 1:
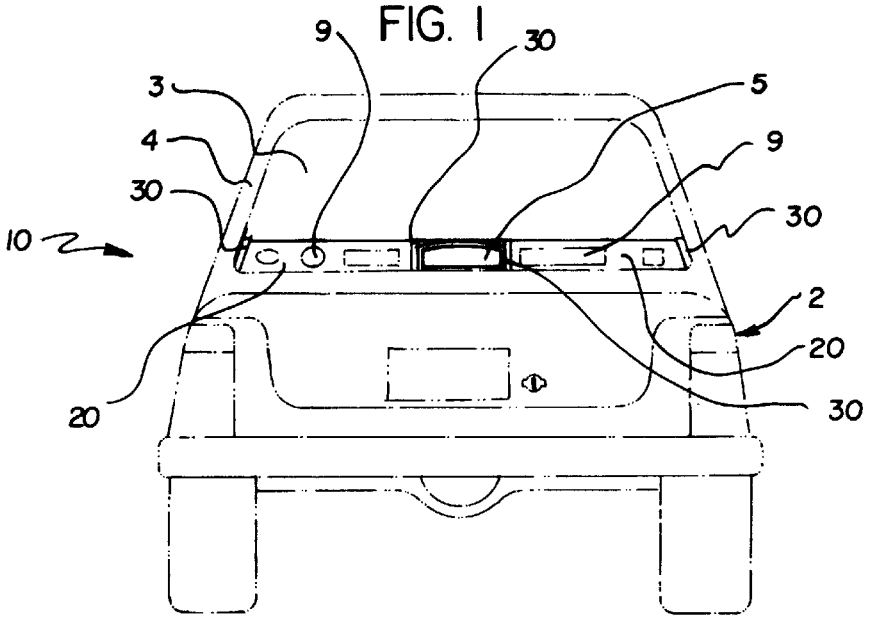
FIG. 1 is an illustration of a new Sticker Display System installed in the rear window of a vehicle according to the present invention.

With reference now to the drawings, and in particular to FIGS. 1 through 7 thereof, a new Sticker Display System embodying the principles and concepts of the present invention and generally designated by the reference numeral 10 will be described.

More specifically, it will be noted that the Sticker Display System 10 comprises a display member 20 and a pair of mounting brackets 30 opposedly mounted in spaced relation adjacent the rear window 3 of a vehicle 2, wherein the display member 20 is removably retained in the mounting brackets 30 and a sticker 9 is attached to the display member 20 so as to be visible through the rear window 3 of the vehicle 2.

The Sticker Display System 10 is intended for use in a rear window 3 of a vehicle 2. The Sticker Display System 10 is mountable to a framework 4 for the rear window 3 and is adaptable for use in the rear window 3 of a vehicle 2 wherein a brake light 5 is mounted adjacent the rear window 3.

Figure 2:
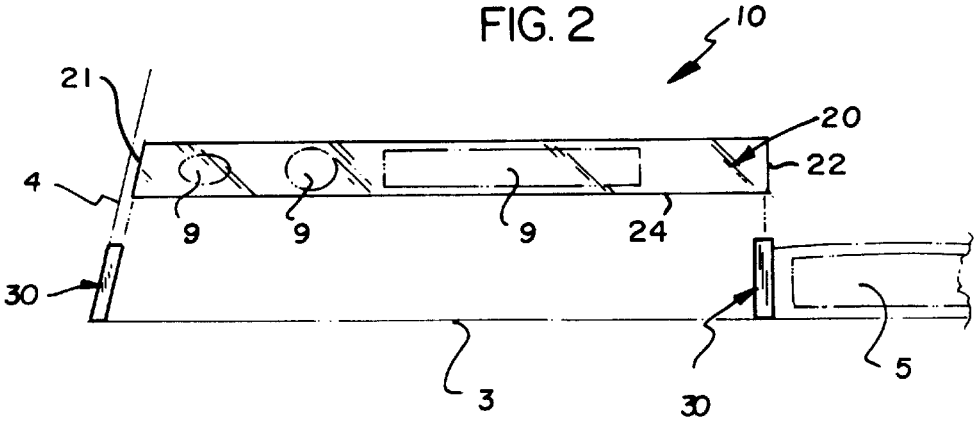
FIG. 2 is a rear view of the installation of the present invention in the rear window of a vehicle.
Figure 3:
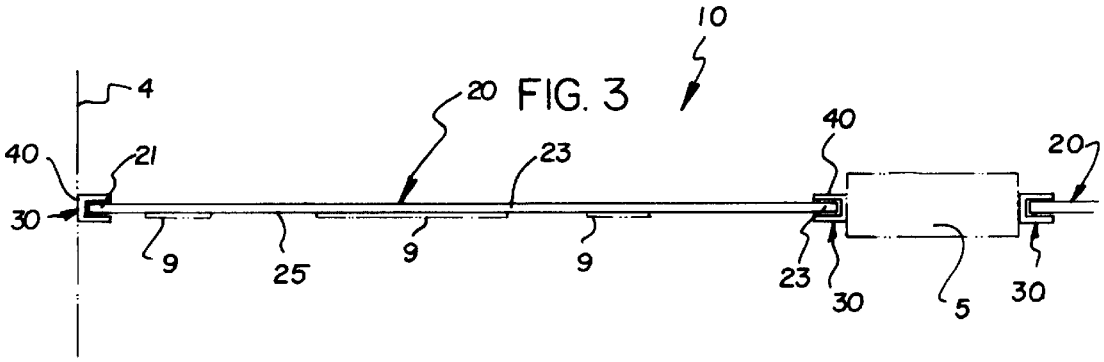
FIG. 3 is top view of the installation of the present invention in the rear window of a vehicle.

As best illustrated in FIGS. 1 through 3, it can be shown that the display member 20 is substantially planar and generally rectangular in shape. The display member 20 has a first end 21 and a second end 22 and has a top 23 and a bottom 24. The display member 20 has a display surface 25 intermediate the first end 21 and the second end 22 for attachment of a sticker 9 thereto. The display member 20 may also be generally trapezoidal in shape wherein the first end 21 and the second end 22 converge from the bottom 24 of the display member 20 towards the top 23 so as to conform to the profile of the rear window 3 of the vehicle 2.

Figure 4:
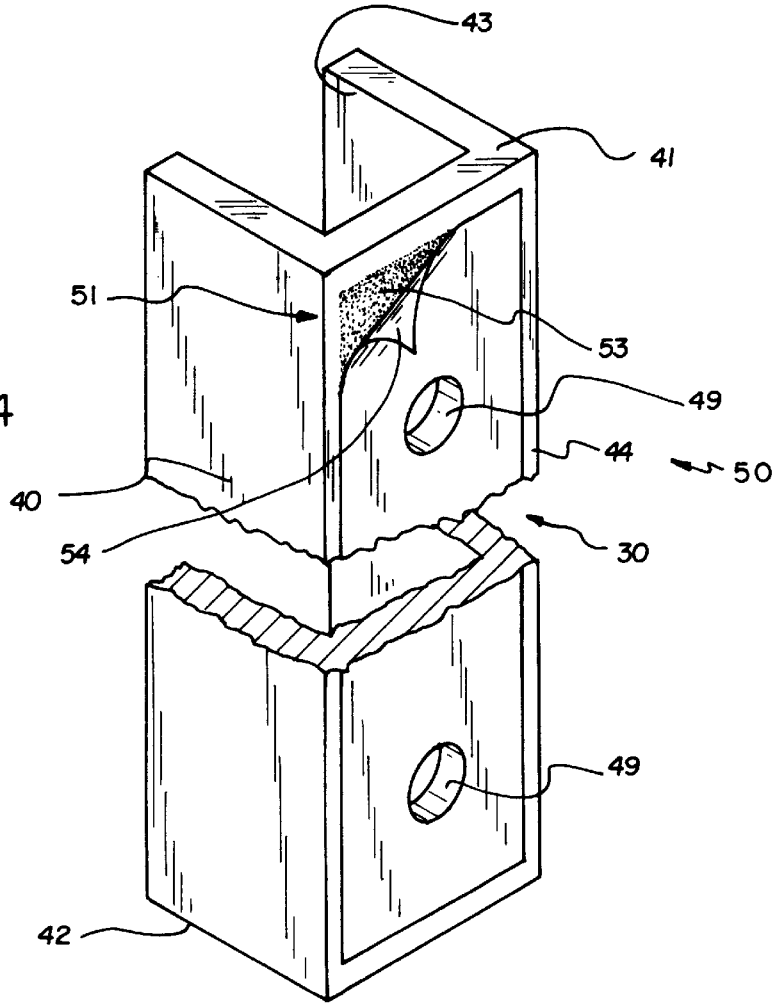
FIG. 4 is an illustration of a mounting bracket of the present invention.

As best illustrated in FIGS. 4 and 5, it can be shown that each of the pair of mounting brackets 30 comprises a U-shaped member 40 and a mounting means 50 for mounting the U-shaped member 40 adjacent the rear window 3 of the vehicle 2. The U-shaped member 40 is adapted to receive and retain one of the first end 21 and the second end 22 of the display member 20. The U-shaped member 40 has a top end 41 and a bottom end 42 and has an inner surface 43 and an outer surface 44. The top end 41 of the U-shaped member 40 is open and the bottom end 42 is closed. The display member 20 is removably retained in the U-shaped member 40 wherein one of the first end 21 and the second end 22 of the display member 20 is slidably inserted through the top end 41 of the U-shaped member 40 whereby one of the first end 21 and the second end 22 of the display member 20 abuts the inner surface 43 of the U-shaped member 40 and whereby the bottom 24 of the display member 20 adjacent one of the first end 21 and the second end 22 of the display member 20 rests on the bottom end 42 of the U-shaped member 40.

The mounting means 50 comprises at least one of an adhesive strip 51 and a screw-type fastener 56. The adhesive strip 51 has a first adhesive side 52 and a second adhesive side 53. A protective sheet 54 is disposed on the second adhesive side 53 of the adhesive strip 51 and is removable so as to reveal the second adhesive side 53. The first adhesive side 52 of the adhesive strip 51 is adhered to the outer surface 44 of the U-shaped member 40 and the second adhesive side 53 is adhered to at least one of the rear window 3 of the vehicle 2, a framework 4 for the rear window 3, and a brake light 5 mounted adjacent the rear window 3.

The U-shaped member 40 has a mounting hole 49 therethrough. The mounting hole 49 is adapted to receive the screw-type fastener 56. The screw-type fastener 56 is insertable through the mounting hole 49 for mounting of the U-shaped member 40 to at least one of a framework 4 for the rear window 3 and a brake light 5 mounted adjacent the rear window 3.

As best illustrated in FIGS. 6 and 7, it can be shown that in a second embodiment of the present invention the display member 120 has a first end 121 and a second end 122 and has a top 123 and a bottom 124. In the second embodiment, the display member 120 has a slot 126 therein. The slot 126 is adapted for insertion of a sticker 9 therein. The slot 126 is provided in the top 123 of the display member 120 and extends substantially from the first end 121 to the second end 122. The display member 120 is formed of a generally clear material such that when the sticker 9 is inserted in the slot 126, the sticker 9 is visible through the display member 120.

In use, the pair of mounting brackets 30 are opposedly mounted in spaced relation adjacent the rear window 3 of the vehicle 2 wherein at least two U-shaped members 40 are mounted adjacent the rear window 3 with the mounting means 50. A sticker 9 is attached to the display member 20 and the display member 20 is slidably inserted through the top ends 41 of the U-shaped members 40 whereby the first end 21 of the display member 20 abuts the inner surface 43 of a first of the U-shaped members 40 and the second end 22 of the display member 20 abuts the inner surface 43 of a second of the U-shaped members 40 and whereby the bottom 24 of the display member 20 adjacent the first end 21 of the display member 20 rests on the bottom end 42 of the first of the U-shaped members 40 and the bottom 24 of the display member 20 adjacent the second end 22 of the display member 20 rests on the bottom end 42 of the second of the U-shaped members 40.

The display member 20 is removably retained in the U-shaped members 40 such that the sticker 9 is visible through the rear window 3 of the vehicle 2. When a user thereof wishes to remove the sticker 9 from the display member 20, they simply remove the display member 20 from the U-shaped members 40 by slidably lifting the display member 20 out of the U-shaped members 40. Alternatively, in the second embodiment, the sticker 9 is simply inserted in the slot 126 of the display member 120.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicle having sticker display system for displaying a sticker in a rear window of a vehicle, comprising, in combination:

a vehicle having a rear window, said rear window having an inner surface facing an interior of said vehicle, said rear window having a curvature;

a pair of mounting brackets opposedly mounted in spaced relation, said mounting brackets being positioned adjacent the rear window of the vehicle;

wherein each of said mounting brackets has a mounting aperture extending continuously through said mounting bracket from an inner surface to an outer surface of said mounting bracket;

a mounting means for mounting said mounting brackets to an inner surface of said rear window of said vehicle, to a framework of said rear window, and to said brake light;

said mounting means comprising an adhesive strip, said mounting means further comprising a plurality of screw-type fasteners being insertable through said mounting apertures for mounting of said U-shaped members to at least one of said framework and said brake light;

a display member removably retained in said pair of mounting brackets, said display member adapted to hold and display the sticker, and said display member positioned in said pair of mounting brackets such that the sticker is visible through the rear window of the vehicle;

wherein said display member has a top, a bottom, a first end and a second end;

said display member having a display surface intermediate said first and said second ends, said intermediate surface adapted for attachment of the sticker thereto; and wherein said display member is substantially planar and generally trapezoidal in shape;

wherein said first end and said second end converge from said bottom of said display member towards said top for generally conforming to the curvature of the rear view window so as to maximize the size of the intermediate surface positionable adjacent the rear window; and a length of said display member being defined between said first and second ends of said display member, a width of said display member being defined between said top and bottom of said display member, wherein the width is less than about one-quarter the length of the display member.

2. A sticker display system for displaying a sticker in a rear window of a vehicle, the sticker display system comprising:

a pair of mounting brackets opposedly mounted in spaced relation, said mounting brackets adapted for positioning adjacent the rear window of the vehicle, each of said mounting brackets comprising a U-shaped member;

a substantially rigid display member removably retained in said pair of mounting brackets, said display member adapted to hold and display the sticker, said display member positioned in said pair of mounting brackets such that the sticker is visible through the rear window of the vehicle;

wherein said display member has a first end and a second end and has a top and a bottom, said bottom and said second end forming an acute angle adapted for positioning adjacent an outside lower corner of the rear window of the vehicle;

wherein said display member has a single slot therein, said slot provided in said top of said display member and extending continuously from said first end to said second end, said slot adapted for insertion of said sticker therein;

wherein said display member is formed of a generally clear material such that when said sticker is inserted in said slot, said sticker is visible through said display member wherein said U-shaped member has a mounting aperture extending continuously through said U-shaped member from an inner surface to an outer surface of said U-shaped member;

a mounting means for mounting said U-shaped member adjacent said rear window of said vehicle, said mounting means comprising an adhesive strip, said mounting means further comprising a screw-type fastener being insertable through said mounting aperture for mounting of said U-shaped member to at least one of a framework for said rear window; and a length of said display member being defined between said first and second ends of said display member, a width of said display member being defined between said top and bottom of said display member, wherein the width is less than about one-quarter the length of the display member.

3. The sticker display system of claim 2, wherein said U-shaped member is adapted to receive and retain one of said first end and said second end of said display member, said U-shaped member having a top end and a bottom end and having an inner surface and an outer surface, said top end of said U-shaped member being open and said bottom end being closed, and said display member removably retained in said U-shaped member, whereby one of said first end and said second end of said display member is slidably inserted through said top end of said U-shaped member, whereby one of said first end and said second end of said display member abuts said inner surface of said U-shaped member, and whereby said bottom of said display member adjacent one of said first end and said second end of said display member rests on said bottom end of said U-shaped member.

4. The sticker display system of claim 3, wherein said adhesive strip has a first adhesive side and a second adhesive side, said adhesive strip including a protective sheet disposed on said second adhesive side, said protective sheet being removable so as to reveal said second adhesive side of said adhesive strip, said first adhesive side adhered to said outer surface of said U-shaped member and said second adhesive side being adapted for adhering to at least one of said rear window of said vehicle, a framework for said rear window, and a brake light mounted adjacent said rear window.

5. The sticker display system of claim 2, wherein said display member is substantially planar and generally trapezoidal in shape;

wherein said first end and said second end converge from said bottom of said display member towards said top for generally conforming to the curvature of the rear view window.

6. A vehicle having a sticker display system for displaying a sticker in a rear window of a vehicle, comprising, in combination:

a vehicle having a rear window with an inner surface facing an interior of the vehicle, said vehicle having a high-mount brake light being positioned adjacent said rear window at a substantially horizontally centered position on said rear window;

a pair of first mounting brackets;

a pair of second mounting brackets, each of said first mounting brackets and said second mounting brackets mounted on the inner surface of the window of the vehicle in opposed spaced relation with respect to each other, said first mounting brackets and said second mounting brackets each having a top end and a bottom end and having a U-shaped cross section therebetween, said top end being open and said bottom end being closed, said first mounting brackets and said second mounting brackets each having an inner surface and an outer surface;

wherein each of said mounting brackets has a mounting aperture extending continuously through said mounting bracket from said inner surface to said outer surface of said mounting bracket;

a mounting means for mounting said mounting brackets to said inner surface of said rear window of said vehicle, to a framework of said rear window, and to said brake light;

said mounting means comprising an adhesive strip, said mounting means further comprising a plurality of screw-type fasteners being insertable through said mounting apertures for mounting of said mounting brackets to said framework of said rear window and said brake light;

said adhesive strip having a first adhesive side and a second adhesive side, said adhesive strip including a protective sheet disposed on said second adhesive side, said protective sheet being removable so as to reveal said second adhesive side of said adhesive strip, said first adhesive side adhered to said outer surface of said U-shaped member and said second adhesive side being adhered to said rear window of said vehicle;

said screw-type fasteners being insertable through said mounting apertures of said first mounting brackets for mounting of said first mounting brackets to opposite sides of a framework of said rear window, said screw-type fasteners being insertable through said mounting apertures of said second mounting brackets for mounting of said second mounting bracket to opposite sides of said brake light;

a pair of substantially rigid rectangular display members each having a first end and a second end and having a top and a bottom, said display members being removably retained in said first mounting brackets and said second mounting brackets, whereby said first end of one of said display members is slidably inserted through said top end of one of said first mounting brackets and said second end of one of said display member is slidably inserted through said top end of one of said second mounting brackets, whereby said first end of another of said display members is slidably inserted through said top end of another of said first mounting brackets and said second end of another of said display member is slidably inserted through said top end of another of said second mounting brackets, whereby said first ends of said display members abut said inner surfaces of said first mounting brackets and said second ends of said display members abut said inner surface of said second mounting brackets, and whereby said bottoms of said display members adjacent said first ends of said display members rests on said bottom ends of said first mounting brackets and said bottoms of said display members adjacent said second ends of said display members rest on said bottom ends of said second mounting brackets;

wherein each said display member has a single slot therein, said slot provided in said top of said display member and extending continuously from said first end to said second end, said slot being adapted for insertion of said sticker therein such that said sticker is held in a substantially parallel relationship to the inner surface of said window; and a length of each of said display members being defined between said first and second ends of each of said display members, a width each of said display members being defined between said top and bottom of said display members, wherein the width is less than about one-quarter the length of the display member.

7. The sticker display system of claim 6, wherein said display member is formed of a generally clear material such that when said sticker is inserted in said slot, said sticker is visible through said display member.

8. The sticker display system of claim 6, wherein said bottom and said second end form an acute angle adapted for positioning adjacent an outside lower corner of the rear window of the vehicle.

* * * * *